US006960555B2

(12) United States Patent
Anthony et al.

(10) Patent No.: US 6,960,555 B2
(45) Date of Patent: Nov. 1, 2005

(54) RESIN BONDED PARTICULATE ANTI-SEIZE AGENT, LUBRICATING SYSTEM MADE THEREFROM AND METHODS OF MAKING AND USING SAME

(75) Inventors: Joseph Anthony, Houston, TX (US); Herschel McDonald, Red Oak, TX (US); Donald Oldiges, Cypress, TX (US)

(73) Assignee: Jet-Lube, Inc, Houston, TX (US)

( * ) Notice: Subject to any disclaimer, the term of this patent is extended or adjusted under 35 U.S.C. 154(b) by 0 days.

(21) Appl. No.: 10/439,270

(22) Filed: May 15, 2003

(65) Prior Publication Data

US 2004/0229759 A1 Nov. 18, 2004

(51) Int. Cl.[7] ..... C10M 125/00; C10M 161/00

(52) U.S. Cl. ..... 508/136; 508/154; 508/208; 508/219; 106/218; 106/286.6

(58) Field of Search ..... 508/141, 136, 508/154

(56) References Cited

U.S. PATENT DOCUMENTS

| | | | | | |
|---|---|---|---|---|---|
| 3,129,180 | A | * | 4/1964 | Hardy et al. | 508/533 |
| 4,088,585 | A | * | 5/1978 | Karpen | 508/141 |
| 5,093,015 | A | * | 3/1992 | Oldiges | 508/124 |
| 5,180,509 | A | * | 1/1993 | Jacobs | 508/126 |
| 5,286,393 | A | * | 2/1994 | Oldiges et al. | 508/139 |
| 5,348,668 | A | * | 9/1994 | Oldiges et al. | 508/139 |
| 5,536,422 | A | * | 7/1996 | Oldiges et al. | 508/121 |
| 5,547,503 | A | * | 8/1996 | Oldiges et al. | 106/287.18 |

* cited by examiner

*Primary Examiner*—Eileen M. McAvoy
(74) *Attorney, Agent, or Firm*—Robert W. Strozier

(57) ABSTRACT

A coating and bonding composition is disclosed which includes a suspending agent, bonding agent, thinning agent, and a particulate fluoride anti-seize agent designed to bond a particulate fluoride film to the thread surface to prevent seizing and galling. A anti-seize lubricating composition is also disclosed where an environmentally friendly lubricating composition is applied as a top coat to the bonding composition and to methods for making and using the compositions.

16 Claims, No Drawings

RESIN BONDED PARTICULATE ANTI-SEIZE AGENT, LUBRICATING SYSTEM MADE THEREFROM AND METHODS OF MAKING AND USING SAME

BACKGROUND OF THE INVENTION

1. Field of the Invention

The present invention relates to a thread compound composition including a non-metallic anti-seize agent for use in all manner of threaded connections and especially for use in oilfield tool joints, drill collars, casing, tubing, line pipe, flow lines and subsurface production tools and petrochemical plant fasteners.

More particularly, the present invention relates to a thread compound composition including a coating compound comprising a particulate non-metallic, anti-seize agent and bonding composition and a fluid lubricating top coat for use in all manner of threaded connections including oilfield tool joints, drill collars, casing, tubing, line pipe, flow lines, subsurface production tools, oil processing equipment, industrial equipment or the like to provide controlled frictional properties to suit the connection design requirements.

2. Description of the Related Art

Environmental regulations are restricting the use of thread compound products containing substantial amounts of metallic additives such as copper, lead, nickel, zinc, antimony or their salts for many applications. However, generally, thread compounds require these metallic agents to provide galling resistance and frictional properties to the thread compound products for optimum performance. As a result of the environmental restrictions and the removal or reduction in amount of these metallic agents, premature connection wear and failures are more prevalent due to the use of unrestricted agents in place of the metallic agents that have inferior galling resistance and frictional properties.

Oilfield thread forms require products with high film strength and specific coefficient of friction properties. Because thread faces are often subjected to bearing stresses in excess of 50,000 psi, additional downhole connection engagement can result in bearing stresses capable of rupturing the protective "anti-seize" film. This additional engagement can result in wear, galling or complete connection failure.

Conventional anti-seize compounds work by placing a dissimilar metal or metallic containing film between two like substrates. The dissimilar metallic film provides a barrier between the two like substrates to protect against direct contact of the substrates which, under the pressure and heat of use, could result in fusing the substrates together. The fusion could then ultimately result in galling upon disengagement of the connection or in the worst case scenario, cause catastrophic failure of the connection.

In addition to restricting the use of metallic additives, many of the environmental regulations are restricting the use (or the potential introduction into the environment) of various organic fluid additives. These additives chemically react with the substrate to form softer compounds on the surface, which reduce the potential for galling. The organic fluid additives facing regulation include those containing antimony, barium, chlorine, lead, phosphorus, and/or zinc.

Products containing lower quantities of metallic and/or organic fluid additives have been formulated to perform in certain applications. Most commercial products free of these additives, however, still lack the galling resistance and frictional properties required to perform optimally in severe applications.

U.S. Pat. No. 5,093,015 discloses an anti-seize composition including a suspending agent, a resin bonding system, a thinning agent, and a metallic flake. The anti-seize properties of this composition resulted from the bonding of the metallic flake to the threaded connection to interpose a dissimilar metal between threaded connection surfaces. Although this composition reduces metal loss into the environment, this composition still relies on a metallic agent to supply the anti-seize protection. In addition, on certain high chrome and high nickel alloys still failed to greatly reduce the incidence of galling to acceptable limits to the connection manufacturers.

Thus, there is a need for an environmentally friendly lubricating system that still provides adequate protection against galling and other damage to threaded connections subject to high bearing stresses, such as those on oilfield tool joints, drill collars and MWD (monitor while drilling) tools, adequate film strength properties to protect such threaded connections from galling or failure, that reduce the additional downhole make-up of threaded connections used in oilfield drilling operations, such as tool joints, drill collars and MWD tools, which may cause galling or other connection damage and that protect threaded connections, enable acceptable thread make-up, and restrict downhole make-up that also minimizes the amount of heavy metals leached into the drilling effluent.

SUMMARY OF THE INVENTION

Anti-Seize Bonded Coating Compositions

The present invention provides an anti-seize composition including a particulate, non-metallic, anti-seize agent and a resin bonding system, where the composition is designed to bond to contacting surfaces to form an anti-seize film with adequate film strength to protect the surfaces from seizing, galling, or failure and to minimize metal release into the environment during engaging and disengaging the contacting surfaces.

The present invention also provides an anti-seize composition including a particulate, non-metallic, anti-seize agent, a resin bonding system, and an anti-wear additive system.

The present invention also provides an anti-seize composition including a particulate, non-metallic, anti-seize agent and a resin bonding system comprising a suspending agent, a bonding agent, and a thinning agent.

The present invention also provides an anti-seize composition including a particulate, non-metallic, anti-seize agent, an anti-wear additive system and a resin bonding system comprising a suspending agent, a bonding agent, and a thinning agent.

Anti-Seize Bonded Coating and Lubricating Compositions

The present invention can also provide an anti-seize/lubricating composition including a bonded surface coat comprising a particulate, non-metallic, anti-seize agent and a resin bonding system and a top coat including a fluid or semi-fluid (non-cured, nonhardening-nonsetting) environmentally friendly lubricating system, where the term environmentally friendly means that the lubricating system contains material that are not considered to be substantial risks to the environment or minimally adversely affect the environment.

The present invention also provides an anti-seize/lubricating composition including a bonded surface coat comprising a particulate, non-metallic, anti-seize agent, an anti-wear additive system and a resin bonding system and a top coat including a fluid or semi-fluid (non-cured, nonhardening-nonsetting) environmentally friendly lubricating system.

The present invention also provides an anti-seize/lubricating composition including a bonded surface coat comprising a particulate, non-metallic, anti-seize agent and a resin bonding system comprising a suspending agent, a bonding agent, and a thinning agent and a top coat including a fluid or semi-fluid (non-cured, nonhardening-nonsetting) environmentally friendly lubricating system.

The present invention also provides an anti-seize/lubricating composition including a bonded surface coat comprising a particulate, non-metallic, anti-seize agent, an anti-wear additive system and a resin bonding system comprising a suspending agent, a bonding agent, and a thinning agent and a top coat including a fluid (non-cured, nonhardening-nonsetting) environmentally friendly lubricating system.

Method for Using the Anti-Seize and the Anti-Seize/Lubricating Compositions

The present invention also provides a method for protecting connections from direct metal-to-metal contact comprising the steps of bonding to the contacting surfaces, prior to make-up, an anti-seize composition of this invention. Once the contacting surfaces are coated with the surface bonding composition, the composition is dried for a time sufficient to bond the composition to the contacting surfaces such as threads. After drying, the bond coated contacting surfaces, prior to make-up, are coated with an excess amount of of a fluid or semi-fluid (non-cured, nonhardening-nonsetting) environmentally friendly controlled friction thread compound composition.

With such a method, it is believed that the anti-seize agent "bonds" to the contacting surfaces such as the surface of threads upon which the bonding composition is applied. Such "bonding" provides the primary anti-seize protection while the lower film strength controlled friction compound allows the connection to reach its required engagement.

DETAILED DESCRIPTION OF THE INVENTION

The inventors have found a coating and bonding composition including a bonding agent and a particulate, non-metallic, an anti-seize agent can be formulated as part of a system for sealing and for anti-seize protection of contacting surfaces, especially, threaded connections associated with industrial piping, tubing, or the like or with oilfield tool joints, drill collars, casing, tubing, line pipe, flow lines, subsurface production tools, or the like. The inventors have found that the compositions of the present invention are particularly well-suited for use in oil drilling operations on galling prone alloys, especially where a nonconductive material is desired.

The inventors have also found that an anti-seize thread compound used to protect and allow the proper engagement of contacting surfaces such as the surfaces of threaded connections under the application of specified torques can be prepared free of metal, metallic flake or metallic agents generally used to form an anti-seize film between the contacting surfaces of threaded connections. The inventors achieved the new anti-seize thread compound by replacing the metal, metal flake or metallic film forming agent with a particulate, non-metallic, anti-seize agent. The particulate, non-metallic, anti-seize agents are combined with a solvent thinned resin bonding system adapted to bond a non-metallic, anti-seize film on the surface of the contacting surfaces such as threaded connection, where the film acts to reduce stress induced galling or seizing between the contacting surfaces such as between thread surfaces of threaded connections during make-up and break-out.

In the coating and bonding composition of the present invention colorant, suspending, dispersant "bonding," thinning agents and driers are combined with a particulate anti-seize agent, producing a composition that may be coated onto the threads of connecting members prior to make-up. The inventors have found that a sprayable form of the composition is ideally suited for oilfield applications, with the preferred sprayable form being an aerosol. The aerosol can utilize appropriate solvents and an HFC 134A propellant to provide a nonflammable aerosol spray, or other conventional solvents with carbon dioxide, hydrocarbons or nitrous oxide propellants.

Suitable suspending agents for use in this invention include, without limitation, any material that may be used to uniformly suspend the composition's other components, in particular, the particulate anti-seize agent. Preferred suspending agents include those conventionally used in paints and coatings, including, for example, thixotropic base materials, such as, but not limited to, those including cellulose, clay or silica and dispersants to reduce settling, caking, etc.

Suitable bonding agent for use in this invention include, without limitation, any material that may bond the particulate anti-seize agent to the contacting surfaces such as threads. Preferably, the bonding agent also encapsulates the particulate anti-seize agent, inhibiting or reducing any adverse properties associated with the agent such as toxicity, corrosiveness or the like. Preferred bonding agents include organic resins, such as resins derived from acrylics, silicones, urethanes, alkyds, hydrocarbons, epoxies, and lacquers.

Suitable thinning agent for use in this invention include, without limitation, any material that ensures that the bonding agent will not harden prior to coating the composition onto the threads. Preferred thinning agents include organic solvents, such as aliphatic, aromatic, ketone, aldehyde, ester, acetate, ether, terpene and chlorinated and cyclopentasiloxane solvents alone or in combination.

Suitable particulate, non-metallic, anti-seize agents include, without limitation, metal fluorides or mixtures of metal fluorides. Exemplary metal fluorides include lithium fluoride (LiF), sodium fluoride (NaF), potassium fluoride (KF), rubidium fluoride (RbF), cesium fluoride (CsF), magnesium fluoride ($MgF_2$), calcium fluoride ($CaF_2$), strontium fluoride ($SrF_2$), yttrium fluoride ($YF_3$), lanthanum fluoride ($LaF_3$), cerium fluoride ($CeF_3$), neodymium fluoride ($NdF_3$), europium fluoride ($EuF_3$), dysprosium fluoride ($DyF_3$), or mixtures or combinations thereof. Preferred metal fluorides include sodium fluoride (NaF), potassium fluoride (KF), rubidium fluoride (RbF), cesium fluoride (CsF), magnesium fluoride ($MgF_2$), calcium fluoride ($CaF_2$), or mixtures or combinations thereof. Particularly preferred metal fluorides include sodium fluoride (NaF), potassium fluoride (KF), rubidium fluoride (RbF), cesium fluoride (CsF), calcium fluoride ($CaF_2$), ceriumn fluoride ($CeF_3$)ormixtures or combinations thereof. Especially preferred metal fluorides include magnesium fluoride ($MgF_2$), calcium fluoride ($CaF_2$), cerium fluoride ($CeF_3$) or mixtures or combinations thereof. Most preferred metal fluoride is calcium fluoride ($CaF_2$). Of course, it should be recognized that the meaning of non-metallic is directed at the fact that the anti-seize composition contains no zero valent metals or metals in their pure metallic state.

The suspending, bonding and thinning agents, and the particulate anti-seize agent, may include a single component or a multiple number of components. For example, the thinning agent may include a combination of solvents having slow and fast evaporating rates. In such an embodiment of the present invention, the fast evaporating solvent inhibits the running and sagging of the film, while the slower evaporating solvent inhibits pin hole formation and promotes surface bonding.

The coating and bonding composition of the present invention may be made using conventional mixing techniques. The components of the composition should be sufficiently blended until they obtain a substantially homogeneous mixture, where substantially homogeneous means that the components will not separation upon standing for at least 4 hours, preferably, 1 day (24 hours), particularly 1 week and especially 1 month. For smaller quantities, blending may take place in a hobart or drum cowles mixer. For larger quantities, the composition maybe made by combining the components in a large kettle mixer and milling them together to produce a substantially homogeneous mixture.

The coating and bonding composition of the present invention may be a solvent thinned resin based composition. Such a composition preferably includes about 0.1–15% by weight of the suspending agent, about 1.0–15% by weight of the bonding agent, about 55–95% by weight of the thinning agent, and about 2.0–25% by weight of the particulate anti-seize agent. More preferably, the solvent thinned resin based composition includes about 0.1–5.0% by weight of the suspending agent, which may include cellulose, clayor silica; about 2.0–10.0% by weight of the bonding agent, which may include an acrylic, a silicone, a urethane, an alkyd, a hydrocarbon, an epoxy, or a lacquer; about 65–90% by weight of the thinning agent, which may include an aliphatic, aromatic, ketone, aldehyde, ester, acetate, ether, terpene, chlorinated or cyclopentasiloxane solvent; and about 5.0–17% by weight of the particulate anti-seize agents set forth above.

Most preferably, such a composition includes about 1.0–3.0% by weight of an ethyl cellulose suspending agent, about 3.0–6.0% by weight of a thermosetting silicone resin bonding-agent, or alkyd resin about 79–89% by weight of a mixed solvent thinning agent, and about 7.0–12% by weight of particulate calcium fluoride. Such a composition should be applied to the threads of the connecting members and allowed to air-dry, preferably for at least one hour. Such a bonded fluoride film has been observed to provide favorable galling resistance. In addition, such silicone or alkyd resins coat the particulate anti-seize agent, rendering it substantially inactive and minimizes any adverse properties of the material such as irritation, toxicity, hydroscopic properties or the like.

The coating and bonding composition of the present invention for use in oilfield applications includes: about 1.0–5.0% by weight of a suspending agent selected from the group consisting of cellulose, clay and silica; about 2.0–8.0% by weight of a bonding agent selected from the group consisting of an acrylic, a silicone, a urethane, an alkyd, a hydrocarbon, an epoxy, and a lacquer; about 70–90% by weight of a thinning agent selected from the group consisting of aliphatic, aromatic, ketone, aldehyde, ester, acetate, ether, terpene, chlorinated and cyclopentasiloxane solvents; and about 5.0–20% by weight of a particulate anti-seize agent selected from the group consisting of lithium fluoride (LiF), sodium fluoride (NaF), potassium fluoride (KF), rubidium fluoride (RbF), cesium fluoride (CsF), magnesium fluoride (MgF2), calcium fluoride ($CaF_2$), strontium fluoride ($SrF_2$), yttrium fluoride (YF3), lanthanum fluoride (LaF3), cerium fluoride ($CeF_3$), neodymium fluoride (NdF3), europium fluoride (EuF3), dysprosium fluoride ($DyF_3$) or mixtures or combinations thereof. Preferred metal fluorides include sodium fluoride (NaF), potassium fluoride (KF), rubidium fluoride (RbF), cesium fluoride (CsF), magnesium fluoride ($MgF_2$), cerium fluoride ($CeF_3$), calcium fluoride (CaF2), or mixtures or combinations thereof Particularly preferred metal fluorides include sodium fluoride (NaF), potassium fluoride (KF), rubidium fluoride (RbF), cesium fluoride (CsF), calcium fluoride ($CaF_2$), or mixtures or combinations thereof. Especially preferred metal fluorides include magnesium fluoride ($MgF_2$), calcium fluoride ($CaF_2$), or mixtures or combinations thereof. Most preferred metal fluoride is calcium fluoride ($CaF_2$).

Such an oilfield threaded connection coating and bonding composition preferably includes about 1.0–3.0% by weight of an ethyl cellulose suspending agent, about 3.0–6.0% by weight of a thermosetting silicone resin or alkyd bonding agent, about 79–89% by weight of an aromatic thinning agent, and about 7.0–12% by weight of a particulate calcium fluoride.

The following examples are illustrative of the coating and bonding composition of the present invention. It will be appreciated, of course, that the proportions of components are variable. Selection of different suspending, bonding and thinning agents, and particulate anti-seize agents, and selection of different weight percentages of such components, can be readily made. Moreover, additional materials that may be added to the composition are a matter of design choice such as colorants and anti-corrosion additives. The examples are thus not in any way to be construed as limitations upon the scope of the present invention.

The coating and bonding composition of the present invention may be used in an environmentally friendly lubricating system that includes that composition together with a fluid or semi-fluid, uncured (nonhardening-nonsetting), environmentally friendly lubricating composition, such as a synthetic or petroleum based fluid thickened with metal carboxylates, silicas, clays or polymers and controlled friction, anti-seize materials.

Suitable fluids include, without limitation, synthetic fluids, petroleum based fluids, natural fluids and mixtures thereof. The fluids of preference for use in the thread compounds of the present invention have viscosities ranging from about 5 to about 600 centistokes. Preferred fluids include, without limitation, polyalphaolefins, polybutenes, polyolesters, esters, vegetable oils, animal oils, other essential oil, and mixtures thereof.

Suitable polyalphaolefins (PAOs) include, without limitation, polyethylenes, polypropylenes, polybutenes, polypentenes, polyhexenes, polyheptenes, higher PAOs, copolymers thereof, and mixtures thereof. Preferred PAOs include PAOs sold by Mobil Chemical Company as SHF fluids and PAOs sold formerly by Ethyl Corporation under the name ETHYLFLO and currently by Albemarle Corporation under the trade name Durasyn. Such fluids include those specified as ETYHLFLO 162, 164, 166, 168, 170, 174, and 180. Particularly preferred PAOs include bends of about 56% of ETHYLFLO now Durasyn 174 and about 44% of ETHYLFLO now Durasyn 168.

Preferred polybutenes include, without limitation, those sold by BP/Amoco Chemical Company and Infinium Chemical Company under the trade names INDOPOL and PARAPOL, respectively. Particularly preferred polybutenes include BP/Amoco's INDOPOL 100.

Preferred polyolester include, without limitation, neopentyl glycols, trimethylolpropanes, pentaerythriols, dipentaerythritols, and diesters such as dioctylsebacate (DOS), diactylazelate (DOZ), and dioctyladipate.

Preferred petroleum based fluids include, without limitation, white mineral oils, paraffinic oils, and medium-viscosity-index (MVI) naphthenic oils having viscosities ranging from about 5 to about 600 centistokes at 40° C. Preferred white mineral oils include those sold by Crompton Chemical, Citgo Lyondell Chemical Company, PSI, and Penreco. Preferred paraffinic oils include solvent neutral oils available from ExxonMobil Chemical Company, high-viscosity-index (HVI) neutral oils available from Shell Chemical Company, and solvent treated neutral oils available from Citgo Lyondell Chemical Company. Preferred MVI naphthenic oils include solvent extracted coastal pale oils available from MVI extracted/acid treated oils available from Shell Chemical Company, and naphthenic oils sold under the names HydroCal and Calsol by Calumet, Ergon or similar manufacturers.

Preferred vegetable oils include, without limitation, castor oils, corn oil, olive oil, sunflower oil, sesame oil, peanut oil, other vegetable oils, modified vegetable oils such as crosslinked castor oils and the like, and mixtures thereof. Preferred animal oils include, without limitation, tallow, mink oil, lard, other animal oils, and mixtures thereof. Other essential oils will work as well. Of course, mixtures of all the above identified oils can be used as well.

Preferred synthetic based fluid compositions include those having a viscosity range of about 20–400 centistokes, including polyalphaolefins, polybutenes, and polyolesters having a viscosity within that range. Preferred polyalphaolefins include those sold by ExxonMobil Chemical Company as SHF fluids and those sold by BP Amoco Chemical under the name Durasyn. Such products include those specified as Durasyn 162, 164, 166, 168 and 174, which are believed to be 6, 18, 32, 45 and 460 centistoke products, respectively. Particularly preferred is a blend of about 56% of the 460 centistoke product and about 44% of the 45 centistoke product. Preferred polybutenes include those sold by BP/Amoco Chemical Company and lnfinium Chemical Company under the tradenames INDOPOL and PARAPOL, respectively. Particularly preferred is BP/Amoco's INDOPOL 100. Preferred polyolesters include neopentyl glycols, trimethylolpropanes, pentaerythritols and dipentaerythritols.

Preferred petroleum based fluid compositions include white mineral, paraffinic and MVI (medium viscosity index) naphthenic oils having a viscosity range of about 20–400 centistokes. Preferred white mineral oils include those available from Crompton Corporation, Citgo Lyondell Chemical Company, PSI and Penreco. Preferred paraffinic oils include solvent neutral oils available from ExxonMobil Chemical Company, HVI (high viscosity index) neutral oils available from Shell Chemical Company, and solvent treated neutral oils available from Citgo Lyondell Chemical Company. Preferred MVI (medium viscosity index) naphthenic oils include solvent extracted coastal pale oils available from MVI extracted/acid treated oils available from Shell Chemical Company, and naphthenic oils sold under the names HydroCal and Calsol by Calumet or other similar manufactures.

The composition of this invention generally form a bonded anti-seize films on the surface of connections, such as threaded connections, the films generally must be thick enough to provide adequate anti-galling, anti-marring and anti-seize properties the to speciality alloys connections; however, not so thick as to interfere with the standard functioning of the connections, i.e., interfere with make-up and break out of the connections. Preferably, the film thickness is between about 0.1 mils and about 2 mils (about 0.0001 inches to about 0.002 inches, about 0.000254 cm to about 0.00508 cm), and particularly, between about 0.5 mils and about 2 mils (about 0.0005 inches to about 0.002 inches, about 0.00127 cm to about 0.00508 cm), and more particularly, between about 1 mil and about 1.5 mils (about 0.001 inches to about 0.0015 inches, about 0.00254 cm to about 0.00381 cm).

The environmentally friendly lubricating composition may consist of a single fluid or a combination of several different fluids so long as the composition provides acceptable performance properties and complies with pertinent environmental regulations. Such a composition may include minor amounts of naturally derived non-toxic solid fillers, such as, for example, calcium carbonate, tricalcium phosphate, cerium fluoride, graphite, mica or talc. The composition may further include conventionally used rust, corrosion and/or oxidation inhibitors. If such additives are desired, they may be mixed into the compositions specified above using conventional mixing techniques.

Such an environmentally friendly lubricating system maybe used in a method for protecting threaded connections that includes the following steps coating the threads, prior to their make-up, with the solvent thinned resin based coating and bonding composition comprising a suspending agent, a bonding agent, a thinning agent, and a particulate anti-seize agent; drying the coated threads for a time sufficient to bond the coating and bonding composition to the threads; and coating the threads, prior to their make-up, with an excess amount of the environmentally friendly lubricating composition to provide then the controlled frictional properties required for specific applications such as those disclosed in U.S. Pat. No. 5,536,422.

The solvent thinned resin and bonding composition may be applied to the threads by simply brushing it on, or, alternatively, by including it in an aerosol spray system, and then simply spraying it onto the threads. The environmentally friendly lubricating composition may be applied to the threads, after the coating composition has dried, by simply brushing it on the threads.

Such a method can include the step of heating the threads after they have been coated with the solvent thinned resin based coating and bonding composition for a sufficient time to increase the resulting film's durability and resistance to galling. A controlled oven may be used to heat the system. Such a heating step should enhance bonding, but should be adequately controlled to limit burning or oxidation.

An environmentally friendly lubricating composition should be selected that is free of environmentally hazardous substances while still providing controlled friction properties for favorable threaded connection protection, proper engagement of threaded members when subjected to API torque values, and acceptable resistance to downhole make-up, when used with the film formed from the coating and bonding composition of the present invention.

EXPERIMENTAL SECTION

EXAMPLE 1

This example illustrations the preparation of a resin bonded anti-seize/sealant composition including about 8.50 wt. % of calcium fluoride as the anti-seize film forming particulate material and uses a silicon bonding resin.

The preparation includes the following ingredient specifications:

| Ingredients | Target Value | Minimum Value | Maximum Value |
|---|---|---|---|
| Trichloroethylene | 40.50 | 38.80 | 41.90 |
| MEK | 24.73 | 23.90 | 35.60 |
| Ethyl Cellulose | 1.00 | 0.90 | 1.10 |
| Calcium Fluoride | 8.50 | 8.00 | 9.30 |
| Silicone Resin | 11.10 | 10.30 | 11.50 |
| BYK-306[a] | 0.50 | 0.35 | 0.75 |
| Dispersant | 0.50 | 0.40 | 0.70 |
| Xylene | 10.00 | 9.00 | 12.00 |
| BYK-410[b] | 0.60 | 0.50 | 0.70 |
| DRI RX[c] | 0.20 | 0.15 | 0.25 |
| ADR[d] | 0.37 | 0.30 | 0.40 |
| Blue Dye | 0.50 | 0.50 | 0.55 |
| MPA-60[e] | 1.00 | 1.00 | 1.50 |
| BYK 088[f] | 0.50 | 0.50 | 1.00 |

[a]a mar inhibitor manufactured by BYK-Chemie, AB,
[b]an anti-settling agent manufactured by BYK-Chemie, AB,
[c]a drying agent,
[d]a resin catalyst,
[e]a rust inhibitor,
[f]a defoamer manufactured by BYK-Chemie, AB The preparation was prepared in a conventional mixer with ingredients added in the order of occurrence with mixing to form a substantially homogeneous preparation, where substantially homogenous means that the composition does not vary more than 5% throughout the mixer. Moreover, the composition can vary in weight percent of the ingredients by ± about 10%, preferably, ± about 5% and particularly ± about 2.5%.

The preparation had the following properties: Density lbs./gal. between about a minimum of 9.00 and a maximum of about 10.00; and Zahn Cup values between a minimum of about 18 seconds and a maximum of about 25.

EXAMPLE 2

This example illustrations the preparation of a resin bonded anti-seize/sealant composition including about 8.50 wt. % of calcium fluoride as the anti-seize film forming particulate material and uses a alkyd bonding resin. P The preparation includes the following ingredient specifications:

| Material | Target Value | Minimum Value | Maximum Value |
|---|---|---|---|
| Acetone | 40.50 | 38.80 | 41.90 |
| MEK | 24.73 | 23.90 | 35.60 |
| Ethyl Cellulose | 1.00 | 0.90 | 1.10 |
| Strontium Phosphate | 2.00 | 1.00 | 3.00 |
| Calcium Fluoride | 6.50 | 6.00 | 8.30 |
| Alkyd Resin | 11.10 | 10.30 | 11.50 |
| BYK-306[a] | 0.50 | 0.35 | 0.75 |
| Dispersant | 0.50 | 0.40 | 0.70 |
| Xylene | 10.40 | 9.00 | 12.00 |
| BYK-410[b] | 0.60 | 0.50 | 0.70 |
| DRI RX[c] | 0.20 | 0.15 | 0.25 |
| ADR[d] | 0.37 | 0.30 | 0.40 |
| Blue Dye | 0.30 | 0.25 | 0.55 |
| MPA-60[e] | 0.80 | 0.75 | 1.50 |
| BYK 088[f] | 0.50 | 0.50 | 1.00 |

[a]a mar inhibitor manufactured by BYK-Chemie, AB,
[b]an anti-settling agent manufactured by BYK-Chemie, AB,
[c]a drying agent,
[d]a resin catalyst,
[e]a rust inhibitor,
[f]a defoamer manufactured by BYK-Chemie, AB The preparation was prepared in a conventional mixer with ingredients added in the order of occurrence with mixing to form a substantially homogeneous preparation, where substantially homogenous means that the composition does not vary more than 5% throughout the mixer. Moreover, the composition can vary in weight percent of the ingredients by ± about 10%, preferably, ± about 5% and particularly ± about 2.5%.

The preparation had the following properties: Density lbs./gal. between about a minimum of 7.00 and a maximum of about 7.60; and Zahn Cup values between a minimum of about 18 seconds and a maximum of about 25.

EXAMPLE 3

This example illustrations the preparation of a resin bonded anti-seize/sealant composition including about 8.50 wt. % of calcium fluoride as the anti-seize film forming particulate material.

The preparation includes the following ingredient specifications:

| Material | Target Value | Minimum Value | Maximum Value |
|---|---|---|---|
| Acetone | 40.50 | 38.80 | 41.90 |
| MEK | 24.73 | 23.90 | 35.60 |
| Ethyl Cellulose | 1.00 | 0.90 | 1.10 |
| Calcium Fluoride | 8.50 | 8.00 | 9.30 |
| Alkyd Resin | 11.10 | 10.30 | 11.50 |
| BYK-306[a] | 0.50 | 0.35 | 0.75 |
| Dispersant | 0.50 | 0.40 | 0.70 |
| Xylene | 12.00 | 10.00 | 14.00 |
| BYK-410[b] | 0.60 | 0.50 | 0.70 |
| DRI RX[c] | 0.20 | 0.15 | 0.25 |
| ADR[d] | 0.37 | 0.30 | 0.40 |

[a]a mar inhibitor manufactured by BYK-Chemie, AB,
[b]an anti-settling agent manufactured by BYK-Chemie, AB,
[c]a drying agent,
[d]a resin catalyst The preparation was prepared in a conventional mixer with ingredients added in the order of occurrence with mixing to form a substantially homogeneous preparation, where substantially homogenous means that the composition does not vary more than 5% throughout the mixer. Moreover, the composition can vary in weight percent of the ingredients by ± about 10%, preferably, ± about 5% and particularly ± about 2.5%.

The preparation had the following properties: Density lbs./gal. between about a minimum of 7.00 and a maximum of about 7.60; and Zahn Cup values between a minimum of about 18 seconds and a maximum of about 25.

All references cited herein are incorporated herein by reference. While this invention has been described fully and completely, it should be understood that, within the scope of the appended claims, the invention may be practiced otherwise than as specifically described. Although the invention has been disclosed with reference to its preferred embodiments, from reading this description those of skill in the art may appreciate changes and modification that may be made which do not depart from the scope and spirit of the invention as described above and claimed hereafter.

We claim:

1. An anti-seize composition comprising a particulate, non-metallic, anti-seize agent and a resin bonding system including a suspending agent, a bonding agent, and a thinning agent, where the particulate anti-seize agent comprises calcium fluoride ($CaF_2$) and where the composition is designed to bond to contacting surfaces to form an anti-seize film with adequate film strength to protect the surfaces from seizing, galling, or failure and to minimize metal release into the environment during engaging and disengaging the contacting surfaces of high chrome or high nickel alloys or others alloys with a high propensity to galling.

2. The composition of claim 1, further comprising an anti-wear additive system.

3. The composition of claim 1, wherein the suspending agent is selected from the group consisting of cellulose, clay, and silica and is designed to uniformly suspend the particulate anti-seize agent in the composition.

4. The composition of claim 1, wherein the bonding agent is selected from the group consisting of an acrylic, a silicone, a urethane, an alkyd, a hydrocarbon, an epoxy, and a lacquer resin where the bonding agent.

5. The composition of claim 1, wherein the organic solvent thinning agent is selected from the group consisting of aliphatic, aromatic, ketone, aldehyde, ester, acetate, ether, terpene, chlorinated hydrocarbon, and cyclopentasiloxane solvents and mixtures or combinations thereof.

6. The composition of claim 1, further comprising a fluid or semi-fluid, uncured, non-hardening, non-setting lubricating top coat applied to the bonded composition coating the contacting surfaces to provide specific frictional properties.

7. The composition of claim 1, wherein the contacting surfaces are surfaces of a threaded connection.

8. The composition of claim 1, wherein the contacting surfaces are surfaces of a high chrome or high nickel alloys threaded connection.

9. An anti-seize composition comprising:

a suspending agent selected from the group consisting of cellulose, clay, and silica;

a resin bonding agent selected from the group consisting of an acrylic, a silicone, a urethane, an alkyd, a hydrocarbon, an epoxy, and a lacquer;

a solvent selected from the group consisting of aliphatic, aromatic, ketone, aldehyde, ester, acetate, ether, terpene, chlorinated hydrocarbon, and cyclopentasiloxane;

a particulate anti-seize agent comprising calcium fluoride ($CaF_2$), where the composition is designed to bond to the surfaces of threaded connections to form an anti-seize film with adequate film strength to protect the threaded connections from seizing, galling, or failure and minimizes metal release into the environment during make-up and break-out of the threaded connections.

10. The composition of claim 9, wherein the contacting surfaces are surfaces of a high chrome or high nickel alloys threaded connection.

11. A method for protecting threaded connections comprising the steps of:

coating the threads, prior to their make-up, with a composition of one of claims 1–8; and drying the coated threads for a time sufficient to bond the composition to the threads.

12. The method of claim 11, further comprising step of:

coating the bond protected threaded connections with a fluid or semi-fluid, uncured, non-hardening, non-setting lubricating top coat to provide specific frictional properties, where the top coat comprises a fluid selected from the group consisting of synthetic fluids, petroleum based fluids, natural fluids and mixtures thereof.

13. A method for protecting threaded connections comprising the steps of:

coating the threads, prior to their make-up, with a composition of one of claims 1–8;

drying the coated threads for a time sufficient to bond the composition to the threads; and coating the threads, prior to their make-up, with an excess amount of fluid or semi-fluid lubricating composition.

14. A method for protecting threaded connections comprising the steps of:

coating the threads, prior to their make-up, with a composition of one of claims 9–10; and drying the coated threads for a time sufficient to bond the composition to the threads.

15. The method of claim 14, further comprising step of:

coating the bond protecting threaded connections with a fluid or semi-fluid, uncured, non-hardening, non-setting lubricating top coat to provide specific frictional properties, where the top coat comprises a fluid selected from the group consisting of synthetic fluids, petroleum based fluids, natural fluids and mixtures thereof.

16. A method for protecting threaded connections comprising the steps of:

coating the threads, prior to their make-up, with a composition of one of claims 9–10;

drying the coated threads for a time sufficient to bond the composition to the threads; and coating the threads, prior to their make-up, with an excess amount of fluid or semi-fluid lubricating composition.

* * * * *